US012691367B1

(12) United States Patent
Elwin et al.

(10) Patent No.: US 12,691,367 B1
(45) Date of Patent: Jul. 28, 2026

(54) ROTATING TARGET AND RAMP ASSEMBLY FOR A PINBALL MACHINE

(71) Applicant: Stern Pinball, Inc., Elk Grove Village, IL (US)

(72) Inventors: Keith Elwin, Elk Grove Village, IL (US); J. Harrison Drake, Jr., Elk Grove Village, IL (US); Richard J Naegele, Elk Grove Village, IL (US)

(73) Assignee: Stern Pinball, Inc., Elk Grove Village, IL (US)

( * ) Notice: Subject to any disclaimer, the term of this patent is extended or adjusted under 35 U.S.C. 154(b) by 491 days.

(21) Appl. No.: 18/330,915

(22) Filed: Jun. 7, 2023

Related U.S. Application Data

(60) Provisional application No. 63/349,877, filed on Jun. 7, 2022.

(51) Int. Cl.
*A63F 7/02* (2006.01)
*A63F 7/30* (2006.01)

(52) U.S. Cl.
CPC ..... *A63F 7/027* (2013.01); *A63F 7/02* (2013.01); *A63F 7/025* (2013.01); *A63F 7/3065* (2013.01); *A63F 2007/3005* (2013.01); *A63F 2007/302* (2013.01); *A63F 2007/3035* (2013.01)

(58) Field of Classification Search
CPC .. A63F 7/02; A63F 7/025; A63F 7/027; A63F 2007/3005; A63F 2007/3035; A63F 2007/302
USPC ..... 273/127 R, 127 D
See application file for complete search history.

(56) References Cited

U.S. PATENT DOCUMENTS 4,615,525 A 10/1986 Wiczer
4,620,706 A 11/1986 Ijdakinro
4,773,646 A * 9/1988 Joos, Jr. ..... A63F 7/3065 273/127 R
4,934,699 A * 6/1990 Kaminkow ..... A63F 7/3065 273/121 A
4,968,031 A * 11/1990 Kaminkow ..... A63F 7/027 273/121 A
5,158,292 A * 10/1992 Hanchar ..... A63F 7/3065 273/127 R
5,181,722 A * 1/1993 Krutsch ..... A63F 7/3065 273/127 R
5,338,031 A 8/1994 Patla, Sr. et al.
5,516,103 A * 5/1996 Lawlor ..... A63F 7/3065 273/127 R
5,580,052 A * 12/1996 Popadiuk ..... A63F 7/027 273/127 R (Continued)

*Primary Examiner* — Kyle R Grabowski
(74) *Attorney, Agent, or Firm* — Greenberg Traurig, LLP

(57) ABSTRACT

A pinball machine includes a game cabinet supporting a playfield having a target and ramp assembly mounted to the playfield. The target and ramp assembly includes a carriage rotatably mountable to the playfield and an actuator operatively coupled to the carriage for rotating the carriage about a rotating axis between a first position and a second position. A target assembly is mounted to a portion of a periphery of the carriage and a ball path, such as a ramp is defined by at least one upstanding wall extending perpendicular from the carriage. In the first position, the target assembly is in a first location relative to the playfield and In the second position, the ball path is in the first location and the target assembly is in a second location relative to the playfield.

17 Claims, 13 Drawing Sheets

(56) References Cited

U.S. PATENT DOCUMENTS

| | | | | |
|---|---|---|---|---|
| 5,913,516 | A * | 6/1999 | Piotrowski | A63F 7/027 273/127 R |
| 6,158,737 | A | 12/2000 | Cornell et al. | |
| 2007/0026918 | A1 | 2/2007 | Sheats | |

* cited by examiner

ROTATING TARGET AND RAMP ASSEMBLY FOR A PINBALL MACHINE

CROSS REFERENCE TO RELATED APPLICATION

This application is a non-provisional application claiming priority from U.S. Provisional Application Ser. No. 63/349,877, filed Jun. 7, 2022, and incorporated herein by reference in its entirety.

FIELD OF THE DISCLOSURE

The present description relates generally to an amusement device, such as a pinball machine, and more particularly to a rotating target and ramp assembly for a pinball machine.

BACKGROUND OF RELATED ART

Amusement game devices, such as pinball machines, redemption games, etc. of the commercial, e.g., revenue generating, and non-commercial, e.g., home entertainment, type are well known in the art. By way of example, U.S. Pat. Nos. 5,338,031, 6,158,737, and U.S. Published Application No. 2007/0026918 illustrate and describe amusement game devices of the type having a cabinet which houses a playfield.

Most pinball games include interactive game play structures such as target and ramps to provide various obstacles for a game ball on the playfield. In order to provide additional variations, some pinball machines include movable play structures.

For example, U.S. Pat. No. 4,968,031 describes a raisable and depressible ramp provided in the playfield.

Meanwhile, U.S. Pat. No. 4,620,706 describes an amusement device which includes a base structure having a playing surface over which ball may be shot at rotating target objects rendered intermittently out-of-sight by the co-action of a plurality of rotating obstacles operatively interposed between the shooter and the target objects. Means are provided for collecting and separating spent shooters from dislodged target object and returning each to their respective starting position for subsequent games and for selectively rotating the targets and the obstacles.

Finally, U.S. Pat. No. 4,615,525 describes a spinning target assembly comprising a post rotatably mounted to the playfield board of a pinball game. A bridge extends over and is substantially parallel to the playfield board. Three spinning target units hang downwardly from the bridge. The bridge and the units carried thereby are rotatable about the axis of the post to any selected position. Each unit includes a pair of supports and a target therebetween and rotatably carried thereby. A switch is associated with each unit and is located in the bridge to sense the number of revolutions of the target.

While the above-referenced patents and applications may be suitable for their intended purposes, there is an identifiable need for improvement thereto.

BRIEF DESCRIPTION OF THE DRAWINGS

For a better understanding of the rotating target and ramp assembly disclosed hereinafter reference may be had to the following drawings.

DETAILED DESCRIPTION

The following description of example methods and apparatus is not intended to limit the scope of the description to the precise form or forms detailed herein. Instead, the following description is intended to be illustrative so that others may follow its teachings.

Referring now to the figures, an example amusement device, such as a pinball machine having a simplified playfield layout, is illustrated. In this example, the pinball machine includes rotating target and ramp assembly for selectively rotating to provide a varied game experience to a user in a limited playfield space.

With reference to the figures, an amusement game device, in the example form of a pinball machine 10 is now described. It is to be appreciated, however, that this example form for the amusement game device is not intended to be limiting. Rather, those of ordinary skill in the art will appreciated that the example rotating target and ramp assembly disclosed hereinafter can be utilized in any type of amusement game device of the commercial and non-commercial type in which it is desired to operate a mechanism as disclosed.

Figure 1:
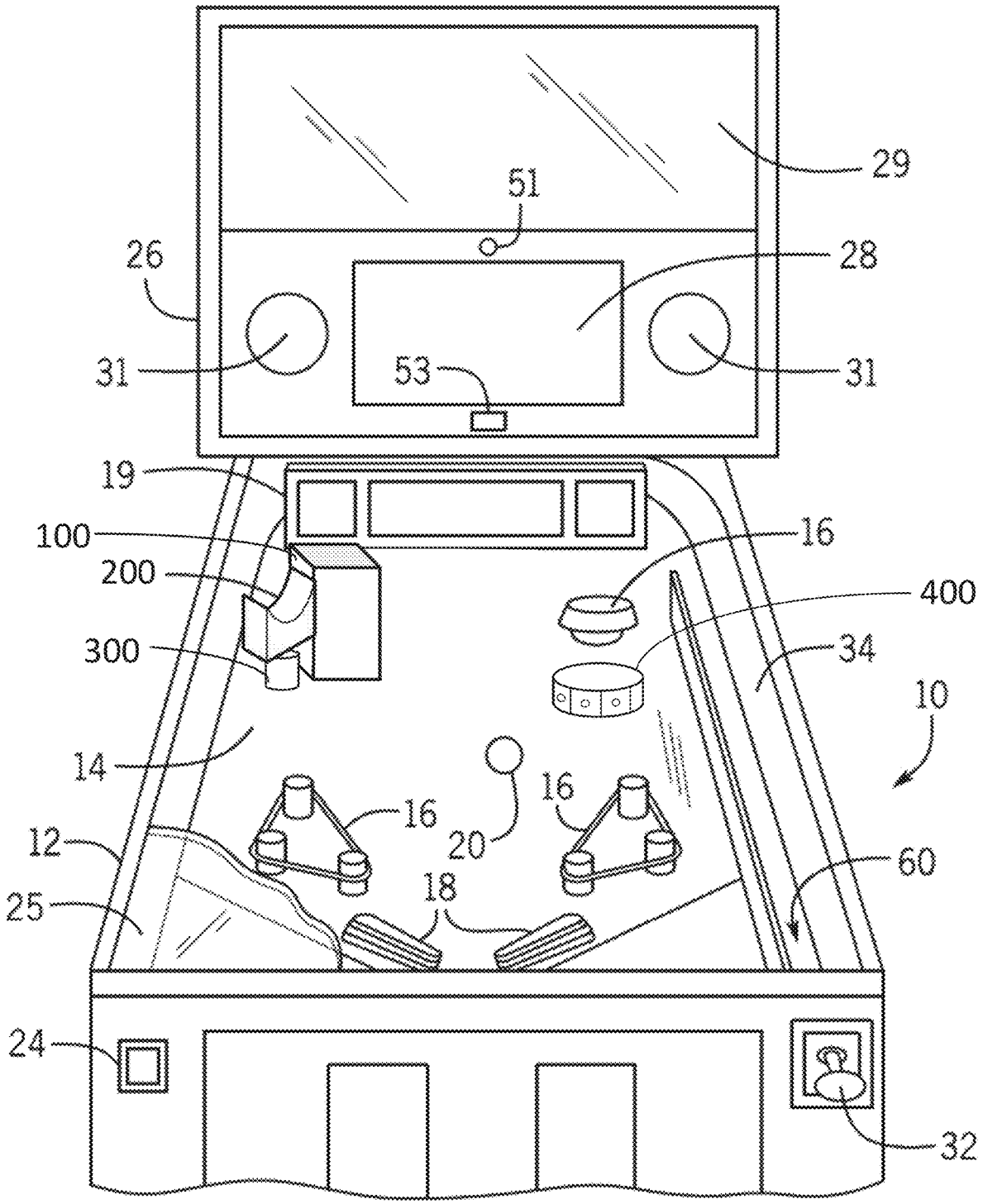
FIG. 1 illustrates an example amusement game device in the form of a pinball machine including an example of the disclosed rotating target and ramp assembly.

The example pinball machine 10 illustrated in FIG. 1 includes a cabinet 12 which houses various apparatus used to define play of a game (e.g., "gameplay"). Gameplay may be commenced in response to insertion of money, paper or coins referred to collectively as "coins", into a coin accepting device, upon exercising of credits earned, by accepting payment from an account, e.g., via use of a swipe card reading device, a bar code reading device, a QR code reading device, a near field communications device, etc., and/or by otherwise making gameplay active, including free play. Upon activation of the game in this manner, gameplay, in the case of the example pinball machine 10, is defined upon an inclined playfield 14 that supports a number of playfield elements, accessories, and/or devices.

Figure 4:
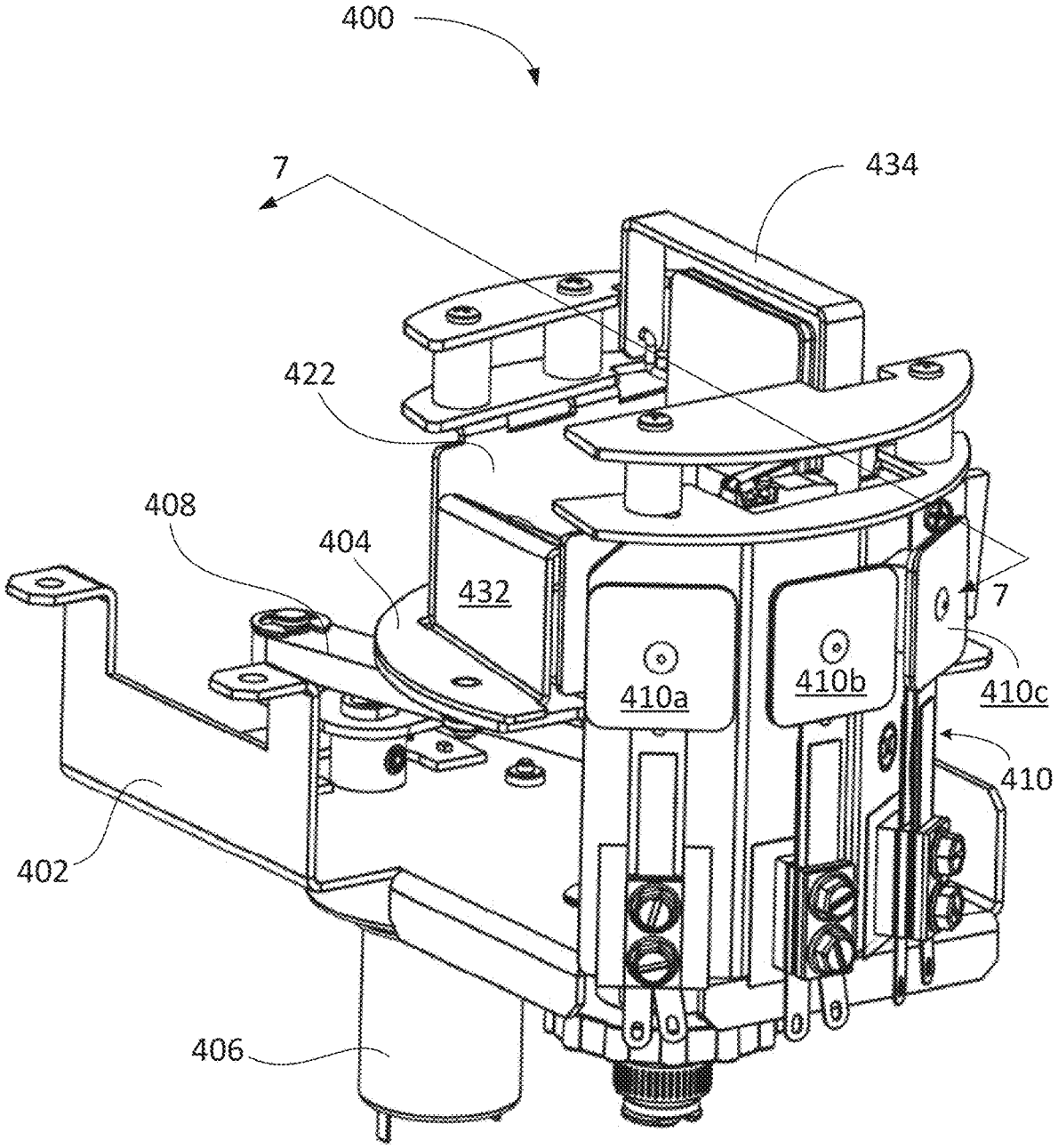
FIG. 4 is first perspective view of an example rotating target and ramp assembly for a pinball machine.
Figure 5:
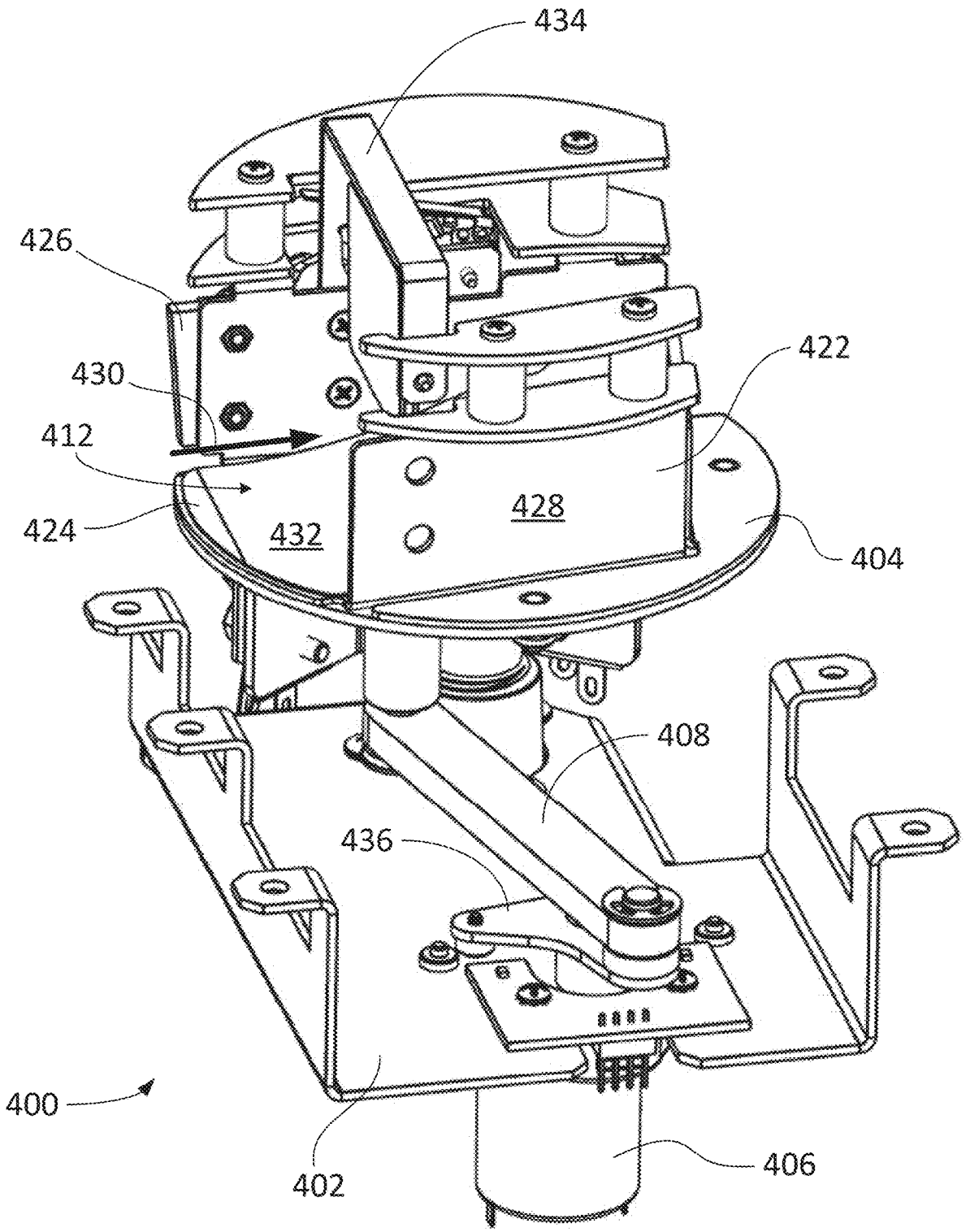
FIG. 5 is second perspective view of the example rotating target and ramp assembly of FIG. 4.
Figure 6:
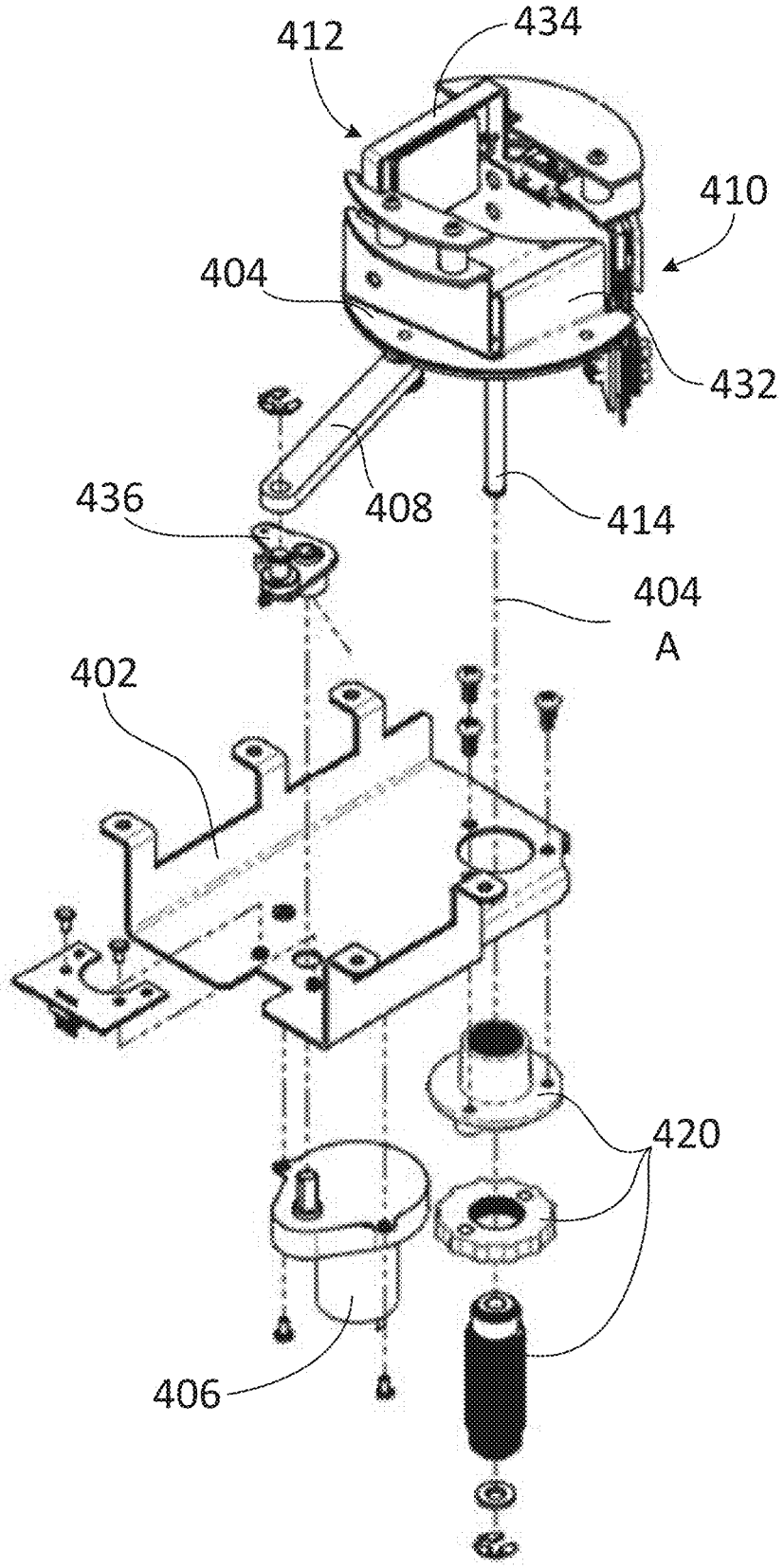
FIG. 6 is a partially exploded perspective view of the example rotating target and ramp assembly of FIG. 4.
Figure 7:
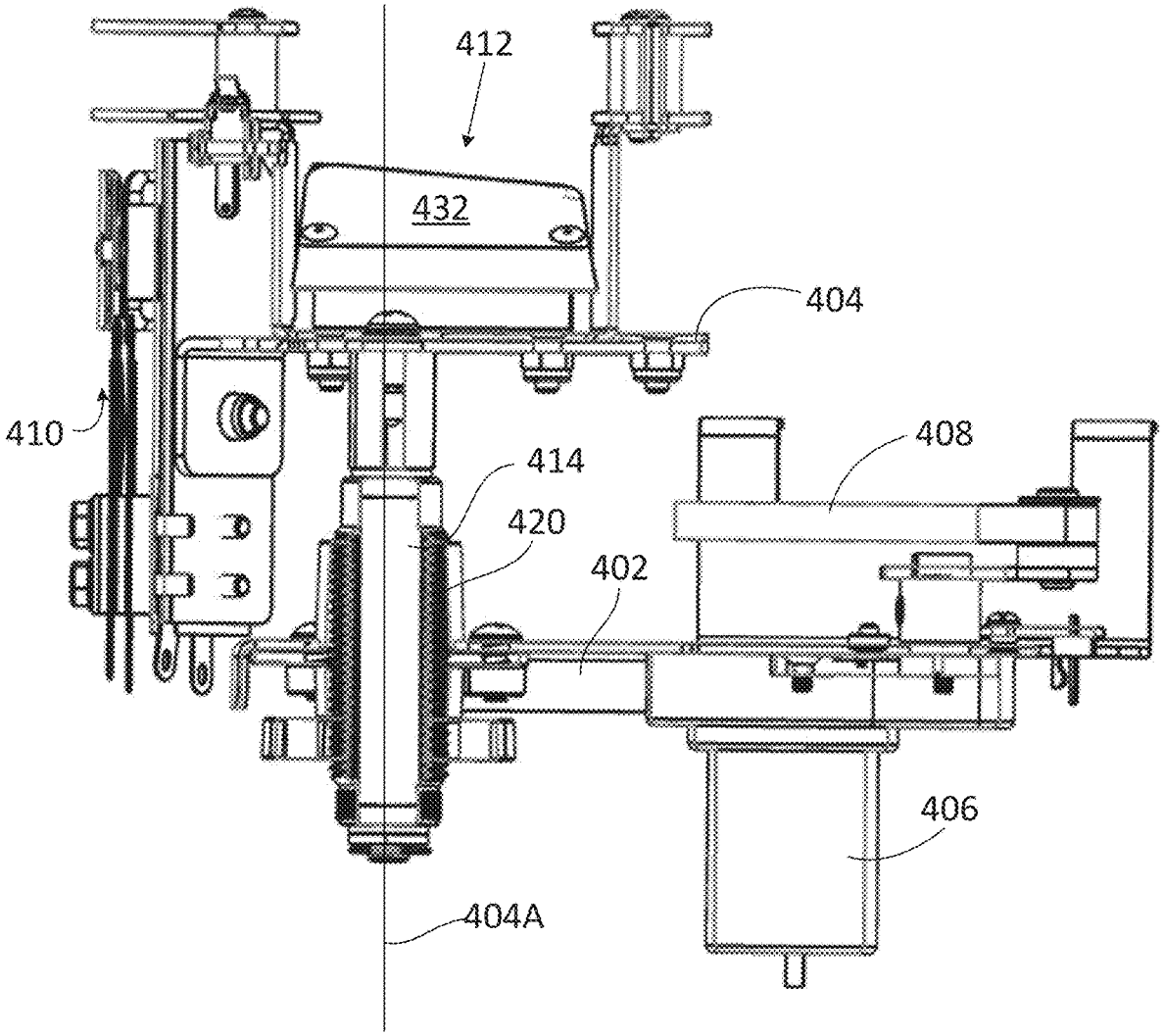
FIG. 7 is a cross sectional view of the example rotating target and ramp assembly of FIG. 4, taken alone line 7-7.
Figure 8A:
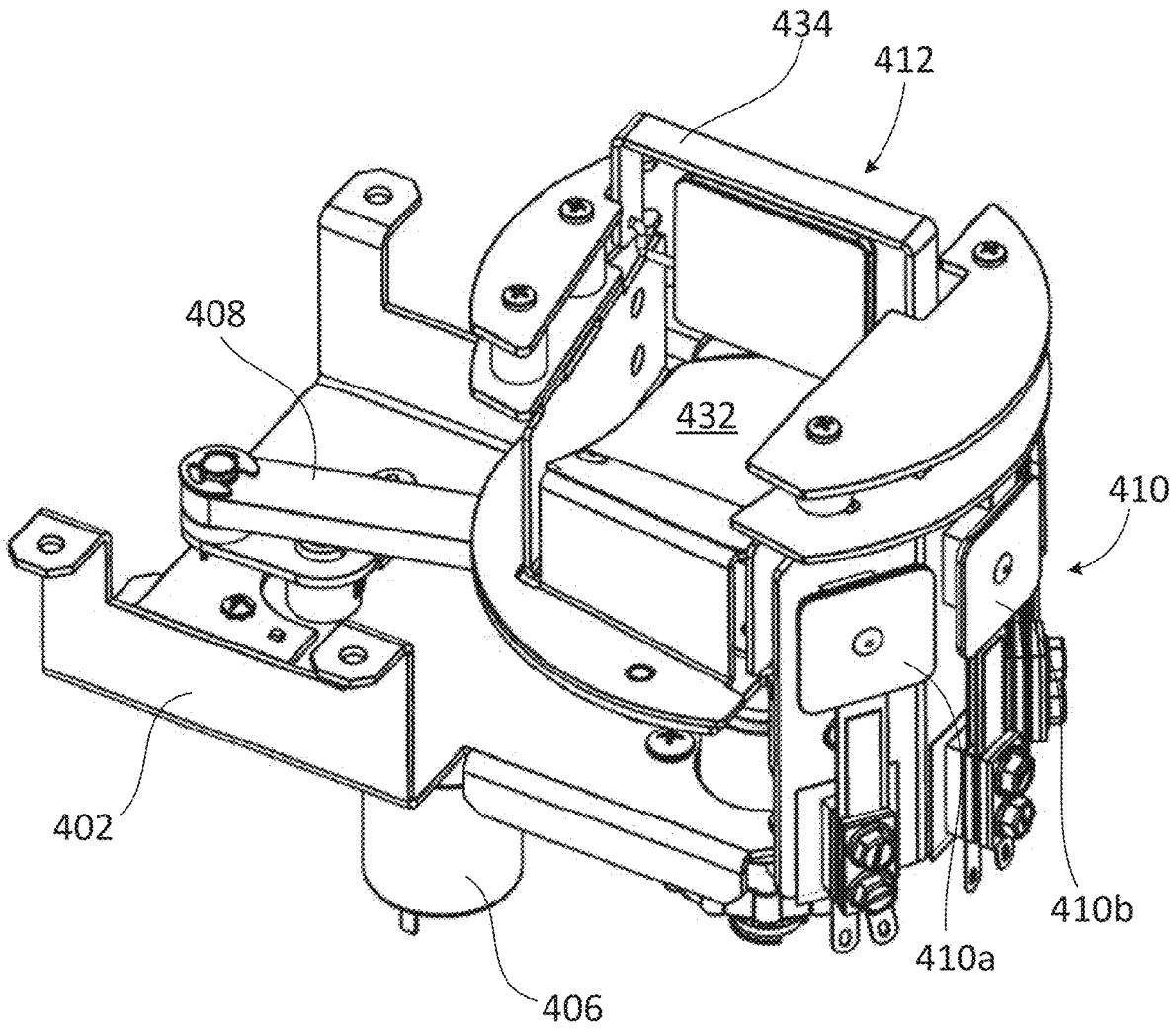
FIG. 8*a* is a perspective view of the example rotating target and ramp assembly in a first position.
Figure 8B:
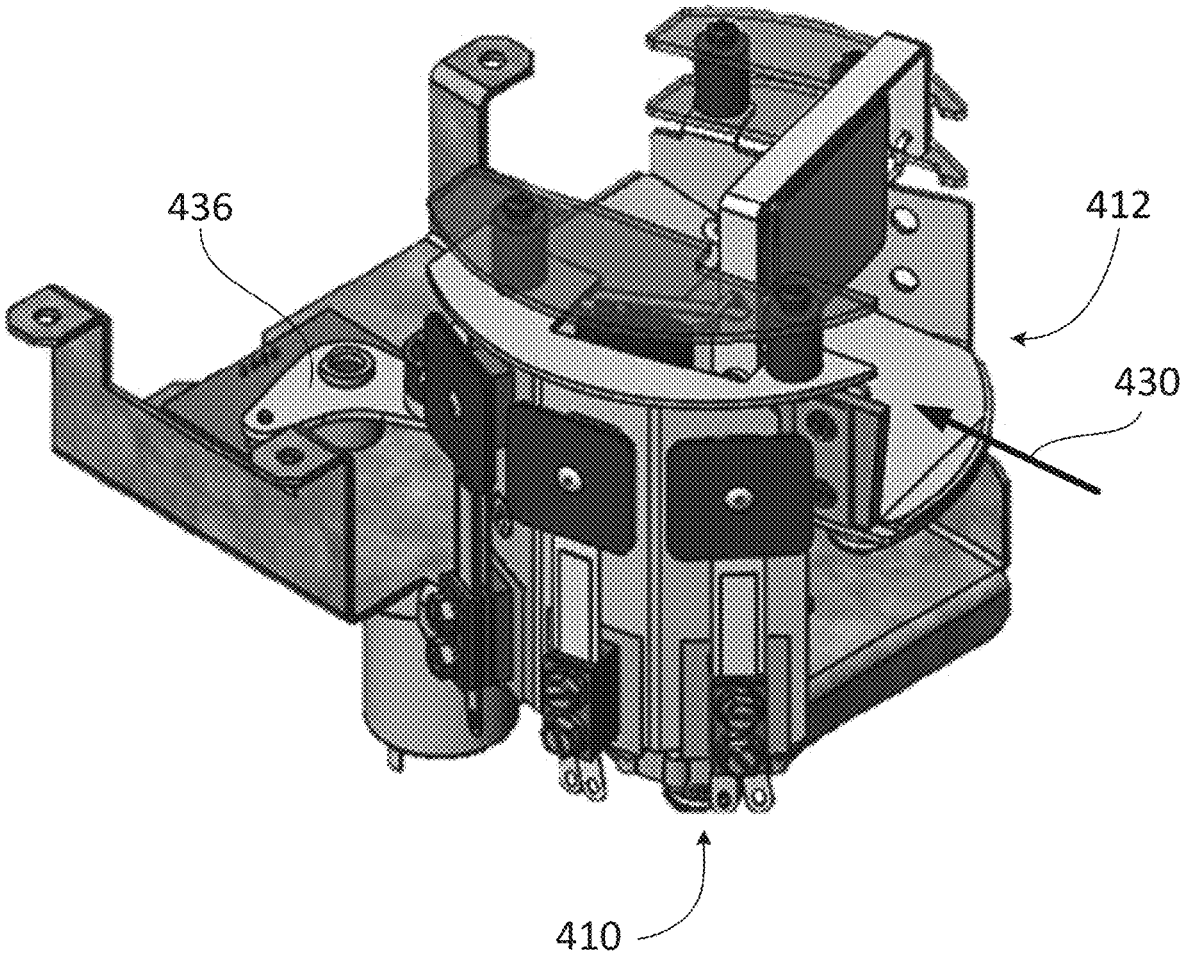
FIG. 8*b* is a perspective view of the example rotating target and ramp assembly in a second position.
Figure 9A:
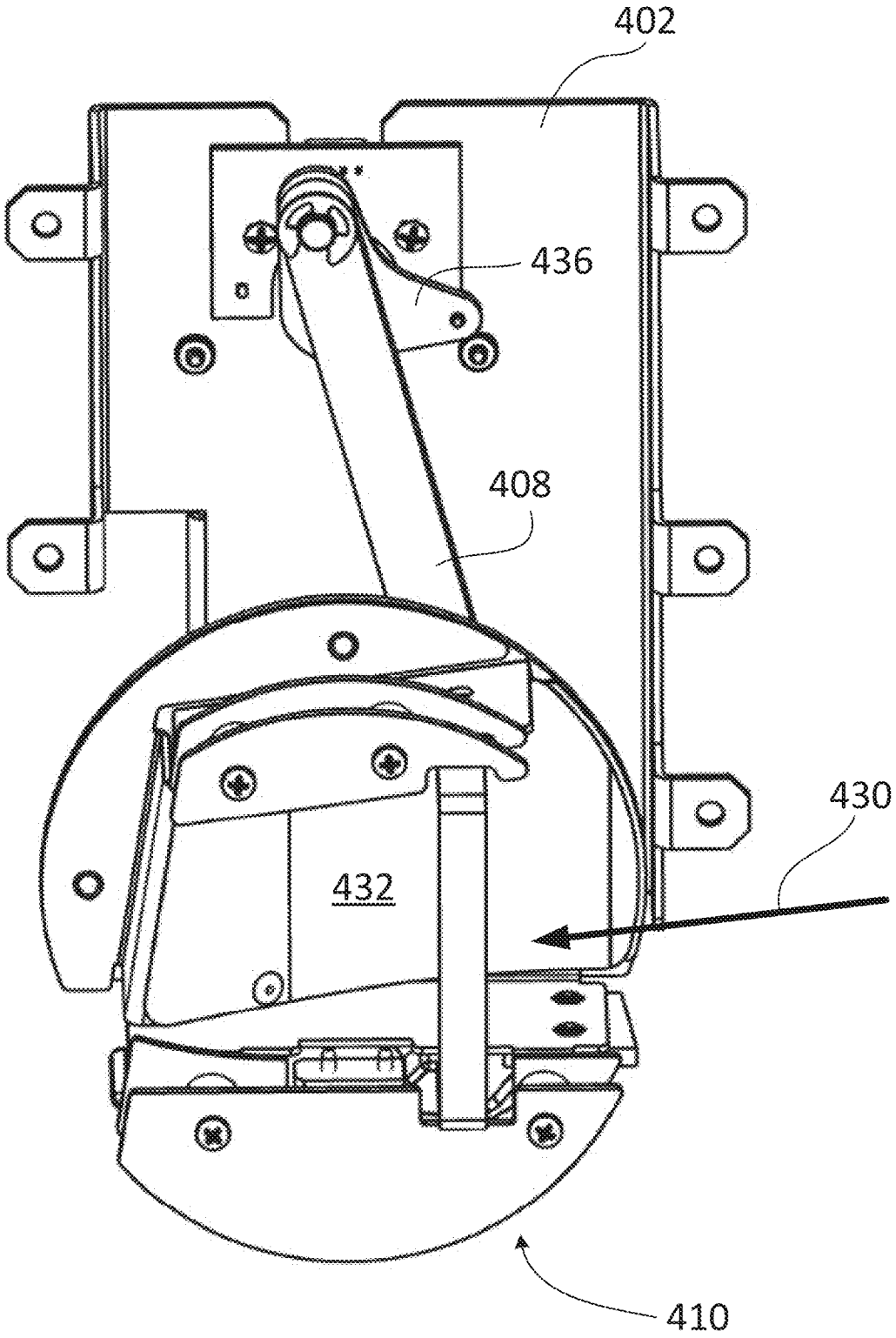
FIG. 9*a* is a top plan view of the example rotating target and ramp assembly of FIG. 8*a* in the first position.
Figure 9B:
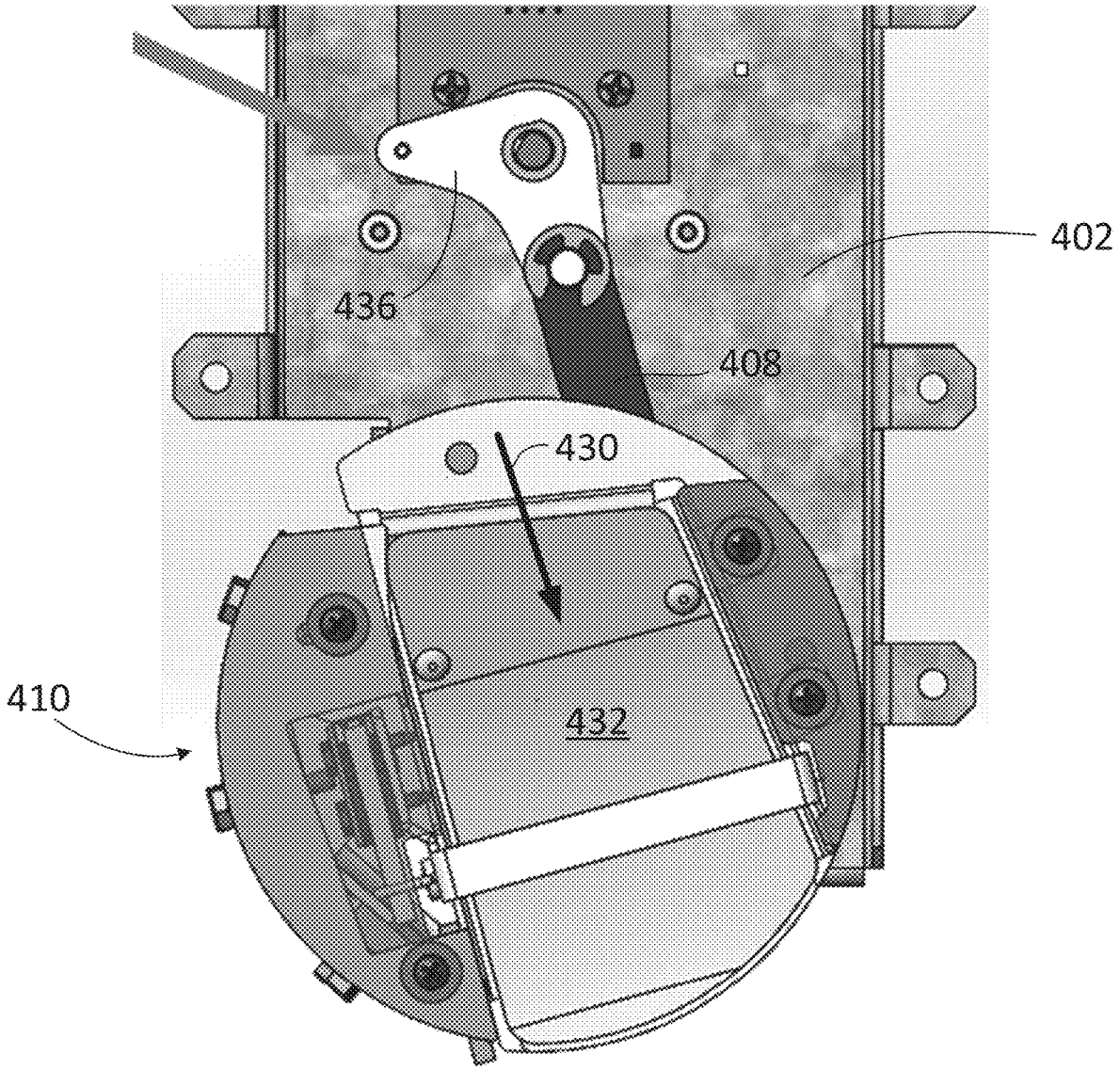
FIG. 9*b* is a top plan view of the example rotating target and ramp assembly of FIG. 8*b* in the second position.

More particularly, in the case of the example pinball machine 10, gameplay is generally defined through the use of a pair of pivotable, flippers 18 to propel a game ball such as a ball 20 for movement relative to an upper side (e.g., a top surface) of the playfield 14 and input devices/accessories associated with the playfield 14. In this example the playfield 14 also includes a backpanel 19 located near an upper portion of the playfield 14 away (e.g. distally located) from the player and the flippers 18. In this example, the backpanel 19 stands upright (e.g., vertical) from the playfield 14. While generally described as being horizontal, the playfield 14 is usually inclined from the horizontal, such as for instance between approximately 6.5 to 7.0 degrees, such that the ball tends to eventually roll back down the playfield 14 in the direction of the flippers 18. While not intended to be limiting, the playfield accessories or input devices may include elements such as bumpers 16, targets (e.g. drop bank targets, spinner targets, etc.) which will be described in greater detail hereinafter. With the present disclosure, the targets, ramps, ball pathways, etc., may include a tiered structure 100, a bridge 200, an electromagnet newton ball and ball diverter assembly 300, and a rotating target and ramp assembly 400. These specific components may include specialized functionality (see FIG. 4 et. seq.) as will be described.

The playfield 14 may be covered by a transparent or glass sheet cover 25 to permit viewing of the playfield 14. In addition to the foregoing, the playfield 14 typically includes a plunger element 32 which shoots or launches the ball 20 up an alley 34 onto the playfield 14. The playfield 14 may also include lighting elements—which may also be included as a part of the any of the input devices/accessories—and/or other features as desired. Other player-activated input elements, typically in the form of push-buttons (not shown) on the sides (or other location) of the cabinet 12, are usually provided for controlling operation of the flippers 18 or otherwise interacting with gameplay. The pinball machine 10 may also include a backbox 26 which is mounted to overlay a top rear portion of the cabinet 12 and which in this example contains artwork 29, and a display 28, such as a dot matrix display, CRT, LED or plasma display, or the like. The backbox 26 may also support speakers 31 associated with the game sound system. Within the backbox 26 may be located various ones of the electronic devices/circuits for controlling the operation of the playfield 14, the display 28, general illumination, and the sound system, including the speakers 31 and any additional sound system components. Such electronic devices/circuits could also, in whole or in part, be carried within the cabinet 12, or may be external to the game cabinet and linked to the pinball machine 10 via any suitable wired or wireless configuration.

Figure 2:
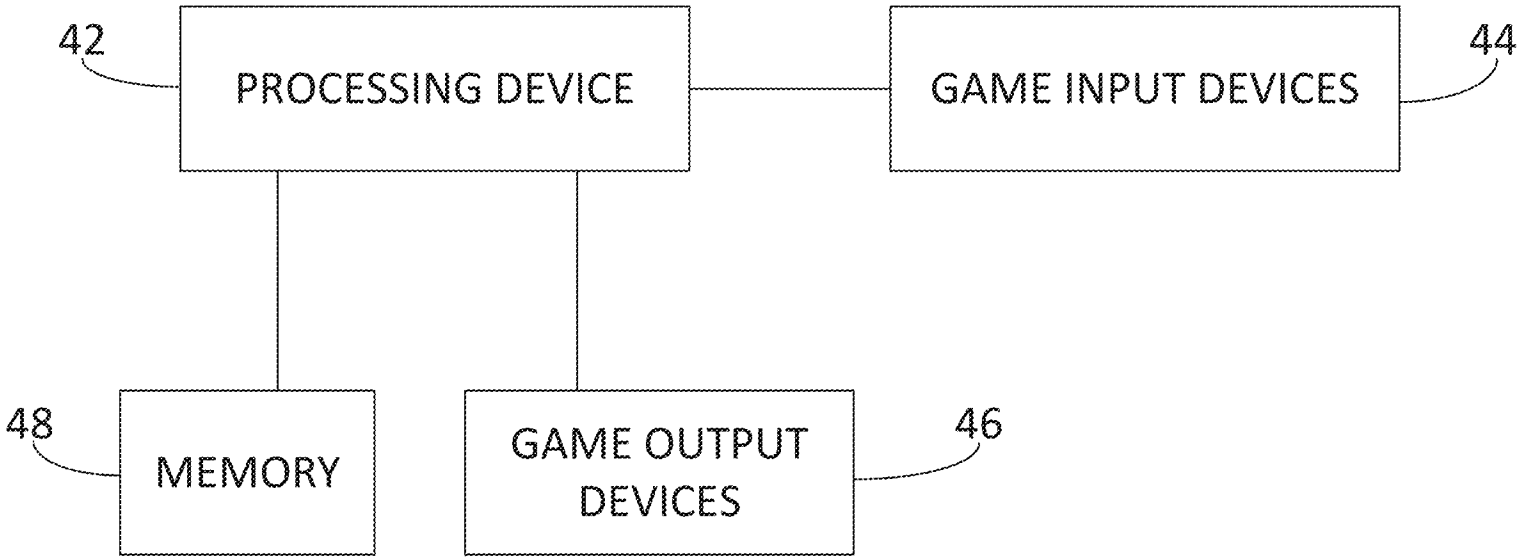
FIG. 2 is an example block diagram of example components of the amusement game device of FIG. 1.

Referring to FIG. 2, for controlling the various devices that form the amusement game, the example pinball machine 10 is provided with a processing device 42 which processing device 42 is, in turn, coupled to game input devices 44, such as switches associated with the cabinet 12 or the playfield 14, and game output devices 46, such as lights (including lights associated with the playfield), the bumpers 16, the flippers 18, the targets, the display 28, the tiered structure 100, the bridge 200, the electromagnet newton ball and ball diverter assembly 300, the rotating target and ramp assembly 400, etc. via one or more bus systems. A memory device 48, such as a RAM, ROM, or the like, stores instructions and data usable by the processing device 42 to control gameplay, the game output devices 46, and the game input devices 44 as necessary based upon signals provided by the game input devices 44. It is to be understood that this illustrated embodiment is not intended to be limiting and that other manners for arranging the devices illustrated in FIG. 2 to provide for control of play of the amusement game can be utilized as needed.

Figure 3:
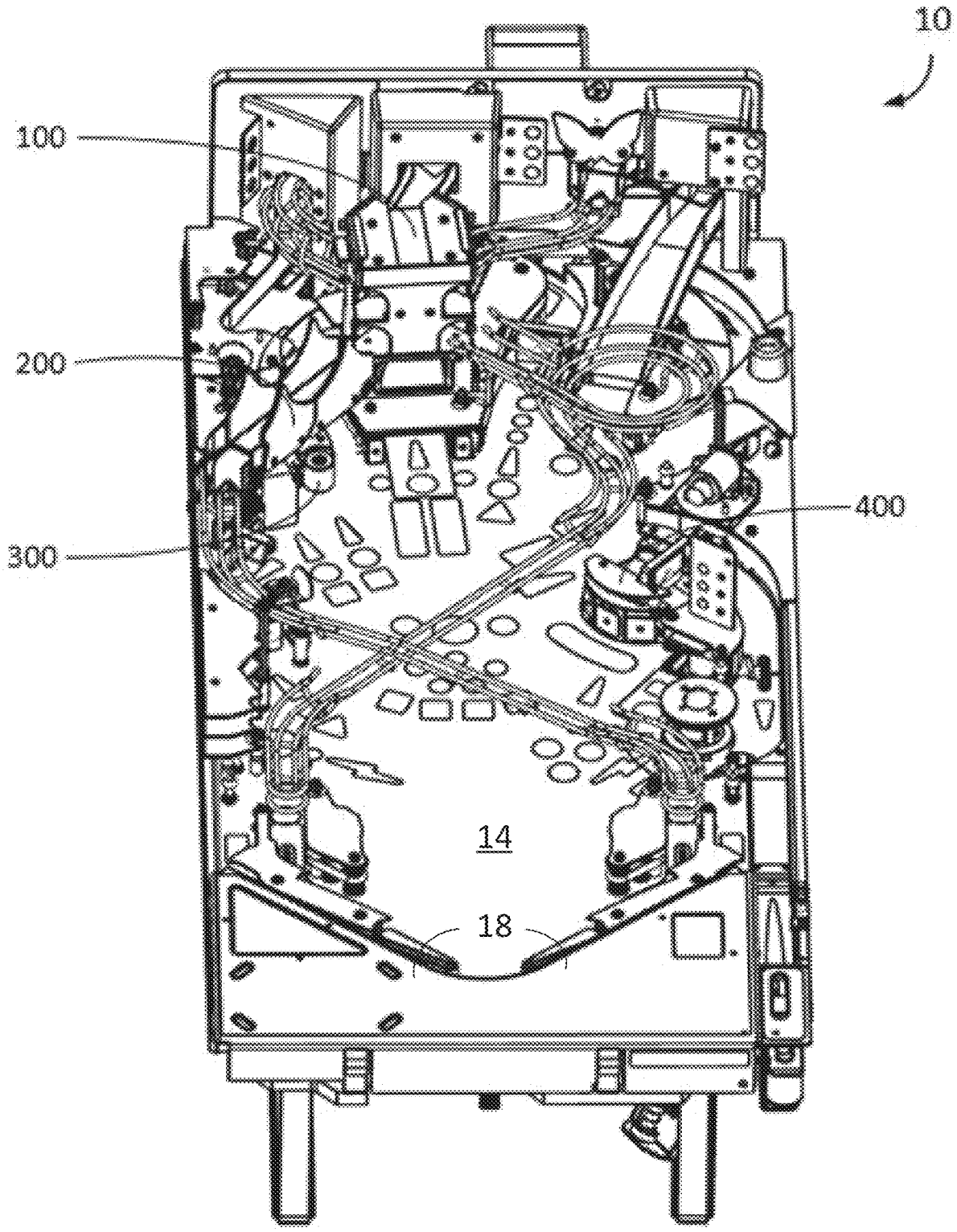
FIG. 3 is a perspective view of an example pinball playfield, including a plurality of gameplay features as disclosed herein.

As also illustrated in FIG. 3, more precisely, the example pinball machine 10 includes the tiered structure 100, which is configured to move in a direction perpendicular to a plane defined by the playfield 14 to provide access for the ball 20 to each of the various tiers that form the tiered structure 100. The tiered structure 100 is described in greater depth in the patent application filed concurrently herewith with Ser. No. 18/330,839, the contents of which are incorporated herein in their entirety and for all purposes.

The example pinball machine 10 also includes the bridge 200, which is formed by two separate components configured to rotate independently of one another. In response to a single mechanical input, the separate components rotate and simulate a collapse of the bridge 200, such that one of the separate components functions as a ramp rather than as gap-traversing path. The bridge 200 is described in greater depth in the patent application filed concurrently herewith with Ser. No. 18/330,839, the contents of which are incorporated herein in their entirety and for all purposes.

The example pinball machine 10 also includes the electromagnet newton ball and ball diverter assembly 300, which is configured to provide an electromagnetic newton ball diverter. The electromagnet newton ball and ball diverter assembly 300 is described in greater depth in the patent application filed concurrently herewith with Ser. No. 18/330,839, the contents of which are incorporated herein in their entirety for all purposes.

The example pinball machine 10 also includes the rotating target and ramp assembly 400, which is configured to provide a selectable, rotatable target and ramp combination. The rotating target and ramp assembly 400 is described in greater depth below.

Referring now to FIGS. 4-11, various examples of a rotating gaming element are illustrated and disclosed including the rotating target and ramp assembly 400. In general, the example rotating target and ramp assembly 400 includes a mounting bracket 402 supporting a carriage 404 and an actuator 406, such as a motor or other suitable device. A link 408 operatively couples the actuator 406 to the carriage 404 for rotating the carriage 404 as will be described. The carriage 404 meanwhile includes a plurality of gaming element mounted thereon, including in this example a three-bank target assembly 410 and a ball ramp 412.

Figure 11:
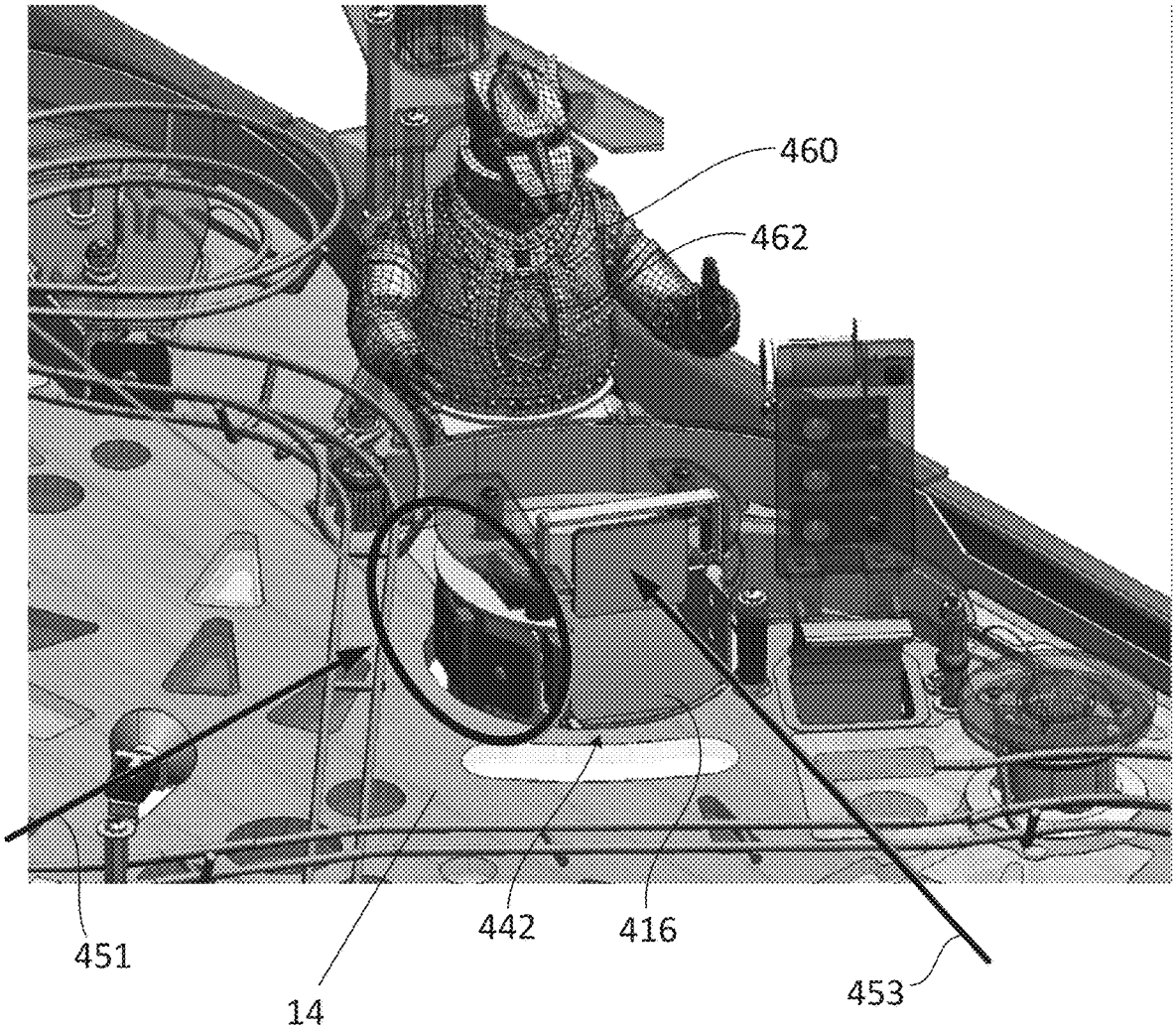
FIG. 11 is a perspective view of the example rotating target and ramp assembly of FIG. 4 installed in a pinball machine and in the second position.

More precisely, as illustrated in FIGS. 11 and 12, rotating target and ramp assembly 400 is mountable to the playfield 14 of the pinball machine 10 such that the gaming elements, in this instance the three-bank target assembly 410 and the ball ramp 412 extend above the playfield 14 a sufficient height so as to be cable of interaction with the ball 20 during gameplay. Furthermore, as will be described the carriage 404 rotates about an axis 404A extending generally perpendicular to the playfield 14 and thus generally horizontal, understanding that the playfield 14 is slightly inclined to facilitate movement of the ball 20.

In further detail, the mounting bracket 402 is mountable to an underside of the playfield 14. In this instance, the mounting bracket 402 provides a support for a rotatable shaft 414. The rotatable shaft 414 is mounted generally perpendicular to the mounting bracket 402 and extends away from the mounting bracket 402 and through an opening 416 defined in the playfield 14. The shaft may be mounted with any suitable elements, including in this example a bushing 420 such as a leveling bushing. As noted above, the carriage 404 is mounted to the rotatable shaft 414 and is in this instance extends generally perpendicular to the rotatable shaft 414 and thus generally parallel to the mounting bracket 402. The carriage 404 may be supported above the playfield 14, flush with the playfield 14 or slightly below the upper surface of the playfield 14 (i.e., within the opening 416) as desired. In this example, the carriage 404 is mounted slightly below the surface of the playfield 14 to provide a proper operating height for the ball 20 to interact with the features mounted to the carriage 404.

As shown, in this example the carriage 404 comprises the three-bank target assembly 410 and the ball ramp 412, mounted to the carriage 404 such that, together, the carriage 404, the three-bank target assembly 410, and the ball ramp 412 rotate as a single unit when rotated. In this instance, the carriage 404 is generally circular or otherwise arcuate and the example three-bank target assembly 410 is vertically mounted on the periphery of the carriage 404 along a portion of the outer periphery. The example three-bank target assembly 410 comprises a plurality, in this instance three, individual targets 410*a*, 410*b*, 410*c*, such as traditional leaf-spring targets although additional or fewer targets may be utilized and/or any suitable type of target may be utilized. In this example, each of the targets 410*a*, 41*b*, 410*c* in the three-bank target assembly 410 extends through the opening 416 in the playfield 14 to only expose an interactive portion of each of the targets above the playfield 14, while allowing the mounting and electrical portions of the leaf-spring targets to be disposed below the surface of the playfield 14.

Also in this example, the carriage 404 supports a frame 422 above the carriage 404. In this example, the frame 422 is a generally u-shaped frame having a base surface 424 and two upstanding walls, namely a first upstanding wall 426 and a second upstanding wall 428. The example frame 422 is mounted with one of the first upstanding wall 426 or the second upstanding wall 428 adjacent the three-bank target assembly 410 to provide a ball path 430 transverse to the three-bank target assembly 410. It will be appreciated that the frame 422 may be provided as a simple through path or may include various additional path elements such as a ramp surface 432 to launch and/or elevate the ball 20 when traveling on the ball path 430. For instance, the ramp surface 432 extends from the carriage 404 such that a first end of the ramp surface 432 is flush with the carriage 404 and/or the playfield 14 and a second end of the ramp surface 432 is elevated off the carriage 404 to propel the ball 20 away from the carriage 404 and the playfield 14.

Still further, in this example the frame 422 optionally supports a spinner target 434 within the ball path 430. The spinner target 434 may be any suitable target or sensor (including an optical sensor, magnetic sensor, mechanical sensor, etc.) to provide various game data or interaction functions including for instance to sense the presence, speed, location, etc. of the ball 20 during gameplay. The spinner target 434 in this example is traditional spinner including an arm and a mechanical switch and need not be described in detail.

To rotate the carriage 404 the ramp assembly 400 further includes the actuator 406 such as a motor having a rotatable output shaft. In this example the actuator 406 is mounted to the mounting bracket 402 a distance from the location of the rotatable shaft 414. It will be appreciated that the actuator 406 may be mounted to any suitable mounting bracket including a separate mount or other suitable mounting element. As illustrated, the actuator 406 includes a plate 436 operably coupled to the output shaft of the actuator 406 and the link 408. The link 408, in turn is operably coupled to the carriage 404. In particular, the link 408 is pivotally coupled to the bottom surface of the carriage 404 at a location offset from the connection between the carriage 404 and the rotatable shaft 414. As can be visualized, in the present disclosure the linkage between the actuator 406, the plate 436, the link 408, and the carriage 404 allows the carriage to be rotated between various positions, including a first position 440 illustrated in FIGS. 8*a* and 9*a*, and a second position 442 illustrated in FIGS. 8*b* and 9*b*.

In this instance, full rotation of the actuator 406 (i.e., 360 degrees) does not fully rotate the carriage 404, but rather provide a reciprocating smaller movement arc. In other instances, it may be beneficial to modify the linkage arrangement to provide for other rotation profiles, including full rotation of the carriage 404. It will also be understood that the mechanism for rotating the carriage 404 may be altered to include any suitable linkage between the actuator 406 and the carriage 404 including a direct link (i.e., the actuator 406 directly moves the rotatable shaft 414) or other suitable linkage including different gear sets (e.g., a transmission, a work gear, etc.).

Figure 10:
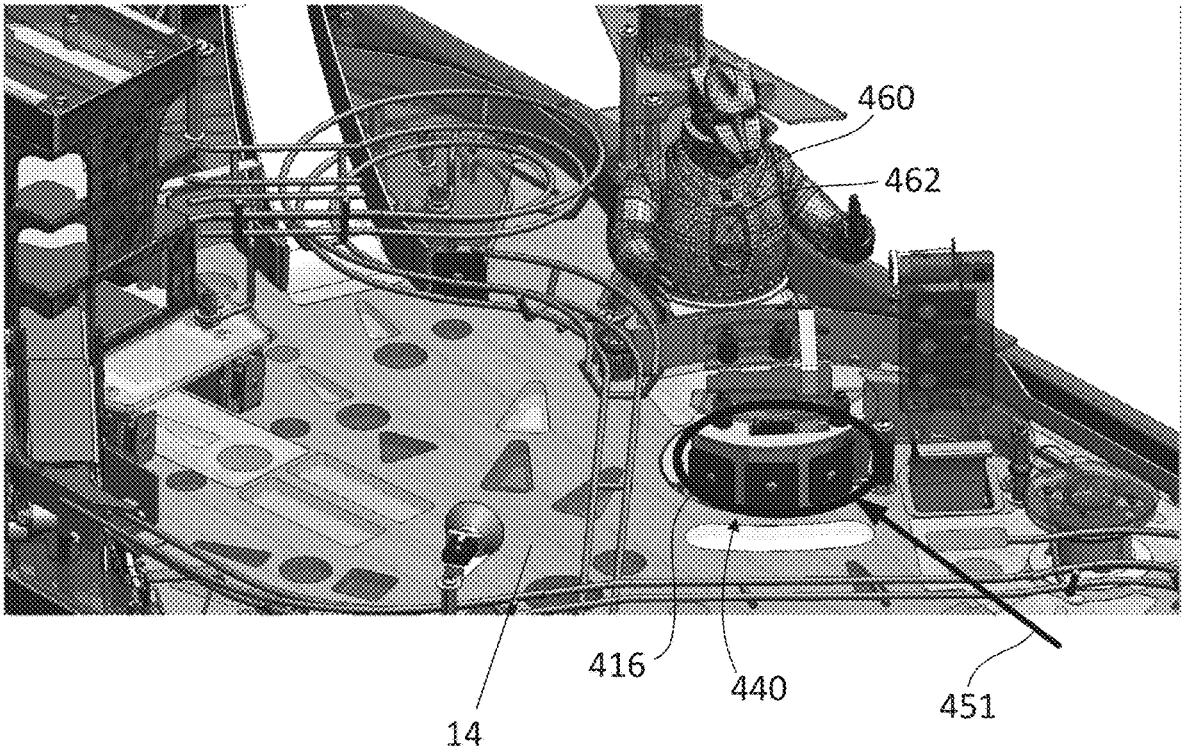
FIG. 10 is a perspective view of the example rotating target and ramp assembly of FIG. 4 installed in a pinball machine and in the first position.

In operation, the ramp assembly 400 provides for a different player experience depending upon the rotational position of the carriage 404 and thus the elements of the three-bank target assembly 410 and ball ramp 412. For example, as illustrated in FIG. 10, the ramp assembly 400 is provided in the first position 440 such that the three-bank target assembly 410 is presented "down" the playfield 14 and thus facing the typical position of the player and the flippers 18. The ball ramp 412 is rotated into a position away from or otherwise hidden from the player and/or the flippers 18. As such, in the first position 440 any movement of the ball 20 across the playfield 14 from the flippers 18, or other portions of the playfield 14 will only interact with the three-bank target assembly 410 and not the ball ramp 412 (see arrow 451). It will be understood that while not provided in this example, the playfield 14 or the carriage 404 may be provided with a surrounding element, such as an upstanding wall, to further limit any portion of the ramp assembly 400 from being interacted with.

During gameplay, any number of gameplay events, such as interaction with the three-bank target assembly 410 or other gameplay event, may cause the processing device 42 to activate the actuator 406 and rotate the ramp assembly 400 into the second position 442, as illustrated in FIG. 11. In this position, the three-bank target assembly 410 is rotated away from the "down" portion of the playfield 14 and towards a side of the playfield 14 while the ball ramp 412 is rotated so as to be presented "down" the playfield 14 and thus facing the typical position of the player and the flippers 18. Thus, in the second position 442 any movement of the ball 20 across the playfield 14 from the flippers 18, or other portions of the playfield 14 will interact with the ball ramp 412 (see arrow 453). In this example, the ball path 430 over the ball ramp 412 causes the ball 20 to launch into a toy 460, which in this instance includes a magnet 462 to "catch" or otherwise temporarily retain the ball 20. In the second position 442, the ball 20 may also interact with the three-bank target assembly 410 (see arrow 451), but as noted, the ramp assembly 400 can be arranged to rotate such that the three-bank target assembly 410 is "hidden" from gameplay or the ramp assembly 400 can include a wall or other device to prevent the ball 20 from interacting with the three-bank target assembly 410.

With the structure and the operation of the ramp assembly 400 disclosed in detail, it will be appreciated by one of ordinary skill in the art that multiple variations of the ramp assembly 400 may be utilized. For example, the elements mounted to the carriage 404 may be varied and/or modified to include additional gameplay elements including magnets, actuatable game elements, etc. Further, as noted the shape and/or rotation profile of the carriage 404 may be altered as desired to provide for various gameplay options as desired.

While specific examples of the present invention have been disclosed in detail, it will be appreciated by one of ordinary skill in the art that that various modifications and alternatives to those details could be developed in light of the overall teachings of the disclosure. Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

What is claimed is:

1. A rotating target and ramp assembly for a pinball machine, the rotating target and ramp assembly comprising:

a carriage rotatably mountable to a playfield of the pinball machine;

an actuator operatively coupled to the carriage for rotating the carriage about a rotating axis extending generally perpendicular to the playfield of the pinball machine when the carriage is mounted to the playfield, the carriage being rotatable between a first position and a second position;

a target assembly mounted to a portion of a periphery of the carriage; and a ball path defined by two upstanding walls extending perpendicular from the carriage, the ball path comprises a ramp surface extending from the carriage such that a first end of the ramp surface is flush with the carriage and a second end of the ramp surface is elevated off the carriage;

such that in the first position, the target assembly is in a first location and when in the second position, the ball path is in the first location.

2. The rotating target and ramp assembly of claim 1, wherein the target assembly is a three-bank target assembly.

3. The rotating target and ramp assembly of claim 1, further comprising a rotatable shaft defining the rotating axis, the rotatable shaft coupling the carriage to a mounting bracket mountable to the playfield of the pinball machine, and the actuator operatively coupled to the carriage to rotate the carriage about the rotatable shaft between the first position and the second position.

4. The rotating target and ramp assembly of claim 3, wherein the actuator is operatively coupled to the carriage via a linkage offset from the rotatable shaft.

5. The rotating target and ramp assembly of claim 4, wherein the actuator is a motor.

6. A rotating assembly for a pinball machine, the rotating assembly comprising:

a carriage rotatably mountable to a playfield of the pinball machine;

an actuator operatively coupled to the carriage for rotating the carriage between a first position and a second position;

a first interactive gaming element coupled to the carriage; and a second interactive gaming element coupled to the carriage, the second interactive gaming element comprising a ramp surface extending from the carriage such that a first end of the ramp surface is flush with the carriage and a second end of the ramp surface is elevated off the carriage, such that in the first position, the first interactive gaming element is in a first location and when in the second position, the second interactive gaming element is in the first location.

7. The rotating assembly of claim 6, further comprising a mounting bracket to mount the rotating assembly to the playfield, the carriage being rotatably mounted to the mounting bracket.

8. The rotating assembly of claim 7, further comprising a rotatable shaft coupling the carriage to the mounting bracket, the rotatable shaft extending generally perpendicular from both the mounting bracket and the carriage and the carriage rotates about the rotatable shaft.

9. The rotating assembly of claim 7, further comprising a rotatable shaft coupling the carriage to the mounting bracket, and further comprising an actuator operatively coupled to the carriage to rotate the carriage about the rotatable shaft between the first position and the second position.

10. The rotating assembly of claim 9, wherein the actuator is operatively coupled to the carriage via a linkage offset from the rotatable shaft.

11. The rotating assembly of claim 10, wherein the actuator is a motor.

12. The rotating assembly of claim 6, wherein the first interactive gaming element is a target assembly mounted to a portion of a periphery of the carriage.

13. The rotating assembly of claim 12, wherein the target assembly is a three-bank target assembly.

14. The rotating assembly of claim 12, wherein the second interactive gaming element is a ball path defined by two upstanding walls extending perpendicular from the carriage.

15. A pinball machine comprising:

a game cabinet supporting a playfield;

a carriage rotatably mountable to the playfield;

an actuator operatively coupled to the carriage for rotating the carriage about a rotating axis extending generally perpendicular to the playfield, the carriage rotating between a first position and a second position;

a motor distally located from the carriage and operably coupled to the carriage via a link offset from the rotating axis such that a rotation of the motor drives the link to rotate the carriage between the first position and the second position;

a target assembly mounted to a portion of a periphery of the carriage; and a ball path defined by at least one upstanding wall extending perpendicular from the carriage, such that in the first position, the target assembly is in a first location relative to the playfield and when in the second position, the ball path is in the first location and the target assembly is in a second location relative to the playfield.

16. The pinball machine of claim 15, wherein the ball path comprises a ramp surface extending from the carriage such that a first end of the ramp surface is flush with the playfield and a second end of the ramp surface is elevated off the playfield.

17. A pinball machine comprising:

a cabinet supporting a playfield; and a rotating target and ramp assembly coupled to the playfield, the rotating target and ramp assembly comprising:

a mounting bracket mountable to an underside of the playfield;

a rotatable shaft supported by the mounting bracket and extending through an opening defined in the playfield;

a carriage coupled to the rotatable shaft and rotatable about a rotating axis extending generally perpendicular to the playfield;

an actuator operatively coupled to the carriage to rotate the carriage about the rotating axis between a first position and a second position;

a target assembly mounted to a portion of a periphery of the carriage; and a frame mounted to the carriage and comprising a base surface and two upstanding walls extending from the base surface and defining a ball path, the ball path comprising a ramp surface extending from the carriage such that a first end of the ramp surface is flush with the carriage and a second end of the ramp surface is elevated off the carriage, the carriage, the target assembly, and the frame being rotatable together as a single unit, the first position including the target assembly disposed at a first location relative to the playfield, and the second position including the ball path disposed at the first location relative to the playfield.

* * * * *